US008075424B1

(12) United States Patent
Hostetler

(10) Patent No.: US 8,075,424 B1
(45) Date of Patent: Dec. 13, 2011

(54) SPORTS TRAINING DEVICE

(76) Inventor: John E. Hostetler, Somers, CT (US)

( * ) Notice: Subject to any disclaimer, the term of this patent is extended or adjusted under 35 U.S.C. 154(b) by 132 days.

(21) Appl. No.: 12/608,100

(22) Filed: Oct. 29, 2009

Related U.S. Application Data

(60) Provisional application No. 61/109,254, filed on Oct. 29, 2008.

(51) Int. Cl.
*A63B 69/00* (2006.01)
*A47F 5/02* (2006.01)

(52) U.S. Cl. ..... 473/447; 248/131; 248/521

(58) Field of Classification Search ..... 473/447, 473/417; 108/25; 248/521, 522, 131, 138, 248/145, 349.1, 99, 519; 211/205, 168, 174, 211/14, 77, 78; 403/326–329; 285/305
See application file for complete search history.

(56) References Cited

U.S. PATENT DOCUMENTS

| | | | | | |
|---|---|---|---|---|---|
| 351,578 | A | * | 10/1886 | Colburn | 211/77 |
| 1,225,866 | A | * | 5/1917 | Schrears | 248/97 |
| 2,794,554 | A | * | 6/1957 | Donner | 211/85.23 |
| 2,939,705 | A | | 6/1960 | McCall, Jr. | |
| 3,139,282 | A | | 6/1964 | Lande | |
| 3,233,896 | A | | 2/1966 | King | |
| 3,283,913 | A | * | 11/1966 | Van Horn, Jr. | 211/78 |
| 3,288,413 | A | * | 11/1966 | Gregory | 248/158 |
| 3,642,145 | A | * | 2/1972 | Shelton | 211/78 |
| 3,814,421 | A | | 6/1974 | Spier | |
| 3,917,263 | A | | 11/1975 | Wiley | |
| 4,227,691 | A | | 10/1980 | Lefebvre et al. | |
| D321,545 | S | | 11/1991 | Myers | |
| 5,388,823 | A | | 2/1995 | Prieto | |
| 5,556,091 | A | | 9/1996 | Lin | |
| 5,928,092 | A | * | 7/1999 | Keeter et al. | 473/417 |
| 5,951,413 | A | | 9/1999 | Guerriero | |
| 6,105,640 | A | * | 8/2000 | Holand et al. | 141/391 |
| D451,566 | S | | 12/2001 | De Chenne | |
| 6,413,175 | B1 | * | 7/2002 | Mooney, Jr. | 473/417 |
| 6,416,429 | B1 | | 7/2002 | Pecoraro et al. | |
| 6,467,756 | B1 | * | 10/2002 | Elsasser | 256/65.14 |
| 6,679,794 | B1 | | 1/2004 | Vitello et al. | |
| 6,695,723 | B2 | | 2/2004 | Leal et al. | |
| 6,949,034 | B2 | | 9/2005 | Vitello et al. | |
| 7,207,450 | B1 | * | 4/2007 | Franklin et al. | 211/205 |
| 7,214,147 | B2 | | 5/2007 | Gutierrez | |
| 7,393,290 | B2 | | 7/2008 | Martin et al. | |
| 7,641,573 | B2 | * | 1/2010 | Cech | 473/417 |
| 2002/0197106 | A1 | * | 12/2002 | Wu | 403/329 |
| 2003/0224881 | A1 | * | 12/2003 | Vitello et al. | 473/447 |
| 2003/0228941 | A1 | * | 12/2003 | Bains | 473/446 |
| 2007/0293355 | A1 | * | 12/2007 | Martin et al. | 473/422 |

* cited by examiner

*Primary Examiner* — Mark Graham
(74) *Attorney, Agent, or Firm* — Doherty, Wallace, Pillsbury & Murphy; Deborah A. Basile; Karen K. Chadwell

(57) ABSTRACT

A sports training device comprising a stand alone unit comprising a ball securing member attached to a telescopic member. The ball securing member comprises a collar, one or more arms attached to the collar, and one or more receiving elements attached to each arm, wherein each receiving element is configured to hold a playing object, such as, a basketball. The collar is adjustably attached to the telescopic member, wherein such attachment effects the variation in the position of each receiving element. Furthermore, the to telescopic member is adjustable in height. The training device, then, allows an athlete to practice throwing a basketball from a variety of positions when received from a variety of heights from the ground of the court.

3 Claims, 6 Drawing Sheets

SECTION A-A

SPORTS TRAINING DEVICE

CROSS REFERENCE TO RELATED APPLICATIONS

This application claims the benefit of U.S. Provisional Application No. 61/109,254 filed on Oct. 29, 2008.

BACKGROUND TO THE INVENTION

1. Field of the Invention

This invention relates to a sports training device. More particularly, the invention relates to a training device useful in enhancing a user's throwing skills, particularly a user's basketball shooting skills.

2. Background of the Invention

Currently, many basketball coaches use standard folding chairs to train their teams in spot shooting. These "chair drills" are used to give shooters repetition to perfect their shooting techniques and form. Often the drills require the athlete to run from one area of the court to another, often called "hot shot" shooting, to practice shooting from various spots. While the method is sound, there are several disadvantages to using chairs for such practice.

Standard chair seats are approximately one to two feet off the floor. This means that most teen or adult shooters must bend to pick up a ball that is well below their knees. Not only can this lead to back strain, it is also simply an unrealistic scenario when preparing athletes for game situations. In addition, the basketball often rolls to the back of the chair or sometimes off the chair entirely as the chair seat is not designed to hold a ball.

From the foregoing, it is evident that a need exists for a practical device that will effectively enhance a user's basketball throwing and/or shooting skills.

SUMMARY OF THE INVENTION

The present invention serves to cure the problems and deficiencies encountered in the prior art by providing a sports training device comprising a stand alone unit comprising a ball securing member attached to a telescopic member. The ball securing member comprises a collar, one or more arms attached to the collar, and one or more receiving elements attached to each arm, wherein each receiving element is configured to hold a basketball. The collar may be adjustably attached to the telescopic member such that the collar can be moved in relation to the telescopic member, e.g., in an exemplary embodiment, the collar may be rotated about a radial axis of the telescopic member, thereby effecting variation in the position of each receiving element. Furthermore, the telescopic member may be adjustable in height. The training device, then, allows an athlete to practice throwing a basketball from a variety of positions on the court when received from a variety of heights from the floor of the court.

Therefore, the present inventive device is designed to provide the versatility that the prior art chair does not offer. For the most basic shooting technique practice, the inventive device's design provides an athlete with the option to grab a ball that is at the athlete's chest level, or in the area that coaches refer to as the "shooting pocket," rather than from knee level. However, the device may also be adjustable, so that the athlete can change the height of the device to accommodate his or her own particular needs. For example, when the telescopic member of the device is adjustable, the device allows a shooter to grab and then shoot the ball from a higher elevation, e.g., over the head, where a ball might be received in a real game situation. Additionally, a forward or center player, who might be catching high passes in a game, would not have to spend time practicing to throw by bending down to retrieve a ball on a chair; rather, such a player, could focus a majority of his/her practice time shooting the ball from a position on the court and from a height on the court more in line with what the player would encounter in real game play. Furthermore, when the telescopic member is adjustable, a single device can be used for practicing, for example, lay-ups, drives, post moves, jump shooting, three pointers, and the like.

Furthermore, in an exemplary embodiment, the arms of the training device are detachable, thereby increasing the versatility of the device. That is, a player can add or subtract the arms from the device to adjust his/her shooting options. For example, in this embodiment, a guard who is working on outside shooting is able to alternate shots from one elbow to the other, using, e.g., one device and two arms. Therefore, rather than resting only one ball on a chair, players can use just one device with multiple arms to incorporate a wide number of basketballs into their drills. This allows for more repetition in a given time, making practice sessions more efficient and productive.

Accordingly, by practicing with the present inventive device, a player's footwork, balance and, therefore, overall shooting form, will be more realistic to game scenarios.

DETAILED DESCRIPTION OF THE INVENTION

Figure 1:
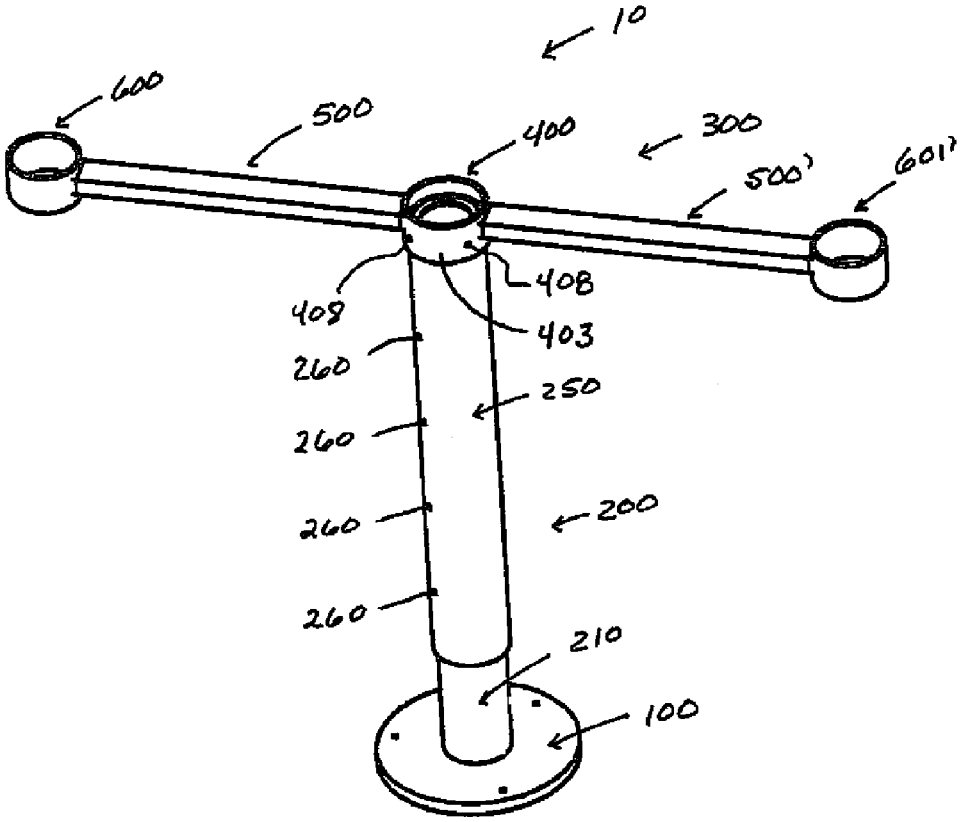
FIG. 1 is a schematic depicting an elevational view of an exemplary training device of the present invention.

The training device of the present invention comprises a stand alone unit comprising a grounded base to which is attached a vertically extending telescopic member, which may be adjustable in height. The adjustability in height of the telescopic member allows for variation in the height of the basketball. In an exemplary embodiment, the telescopic member comprises a sleeve which is telescopically engaged with an extension member, via e.g., one or more sleeve engaging members.

The device further comprises a ball securing member comprising one or more collars, wherein each collar is attached to the telescopic member. Although each of the collars may be fixed onto the telescopic member, in an exemplary embodiment, one or more of the collars is positioned on the telescopic member via, e.g., one or more of a collar receiving member, such that the collar is capable of moving relative to the telescopic mechanism e.g., the collar is capable of rotating about a radial axis of the telescopic member, thereby allowing for variation of the court location of the basketball.

The ball securing member further comprises one or more arms attached to each collar, and one or more receiving elements attached to each arm. The attachment of an arm to a collar and/or the attachment of a receiving element to an arm either may be permanent or temporary, wherein temporary is preferred to increase the transportability and versatility of the device.

One or more of the arms of the present inventive device may comprise a body having a linear configuration, a curved configuration, an angled configuration, or a combination of the foregoing configurations. Additionally, the body of each arm may lie on a single spatial plane, or may lie on two or more spatial planes, e.g., may lie on an X horizontal axis and/or on an X' horizontal axis.

Each receiving member is geometrically configured to hold a basketball. Although the geometrical configuration of the receiver may vary widely, it is important that the geometrical configuration be such that it allows the basketball to be held securely to the receiving member while simultaneously allowing for ready access by the player to the basketball and for ready removal of the basketball from the receiving member by the player.

The device of the present invention may be formed from a variety of materials. In an exemplary embodiment, at least one or all of a portion of the telescopic member, all or a portion of the ball securing member, and all or a portion of the base, is formed from or is enveloped by a padding material, e.g., foam, rubber, and the like. The padding material is especially preferred as it reduces the chance of injury should a user mistakenly run into the device. Additionally, the padding material may be formed to allow for the placement of a school's, program's, or organization's team name, logo, mascot, or advertisement onto the material. In an exemplary embodiment, the padding material is preferably removable from the device, so that the padding material can be transported to gyms, changed, cleaned, and the like.

It is at this point noted that the terms "athlete" and "player" as used herein, are not to be limited to their ordinary meanings, but that the terms refer to any person who uses the present invention according to its intended and obvious purpose.

Additionally, the term "court" is not to be limited to a basketball court per se, but includes any and all grounds on which the practice of basketball occurs, or any other game or sport requiring skills for which the inventive training device would be helpful in developing and/or improving.

Furthermore, although the invention is specifically described with reference to the game of basketball and to the shooting of basketballs, it is not to be limited to such. Rather, the inventive device contemplates the use of a variety of balls and/or objects wherein the device is useful in the teaching of the handling and/or manipulation of the ball. Additionally, the term "shooting" shall also refer to the more general term "throwing", wherein the inventive device is not only useful in the shooting of balls to and/or into a net, but also to the throwing of balls to another player or to some other target.

There has thus been outlined, rather broadly, the more important features of the invention in order that the detailed description thereof that follows may be better understood, and in order that the present contribution to the art may be better appreciated.

There are additional features of the invention that will be described hereinafter. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be made to the accompanying drawings and descriptive matter in which there are illustrated preferred embodiments of the invention. The invention shall now be more full described with reference to the figures, wherein it is to be understood that the invention is not limited to the embodiments depicted in the figures, as the figures are exemplary only, and rather that the invention incorporates modifications and derivations as would naturally occur to one of ordinary skill in the art upon reading the present disclosure.

Figure 3:
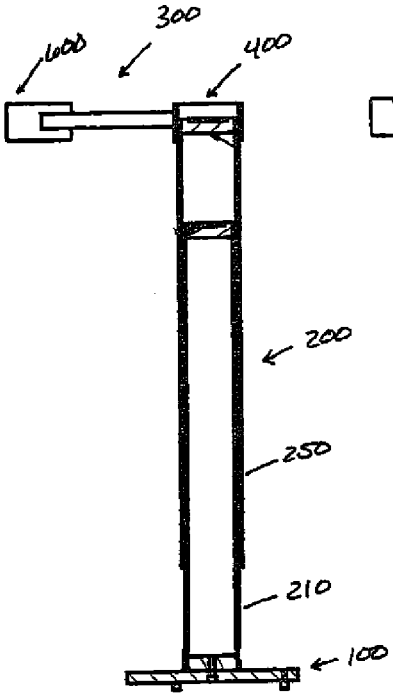
FIG. 3 is a schematic depicting a sectional view of the training device depicted in FIG. 2.
Figure 2:
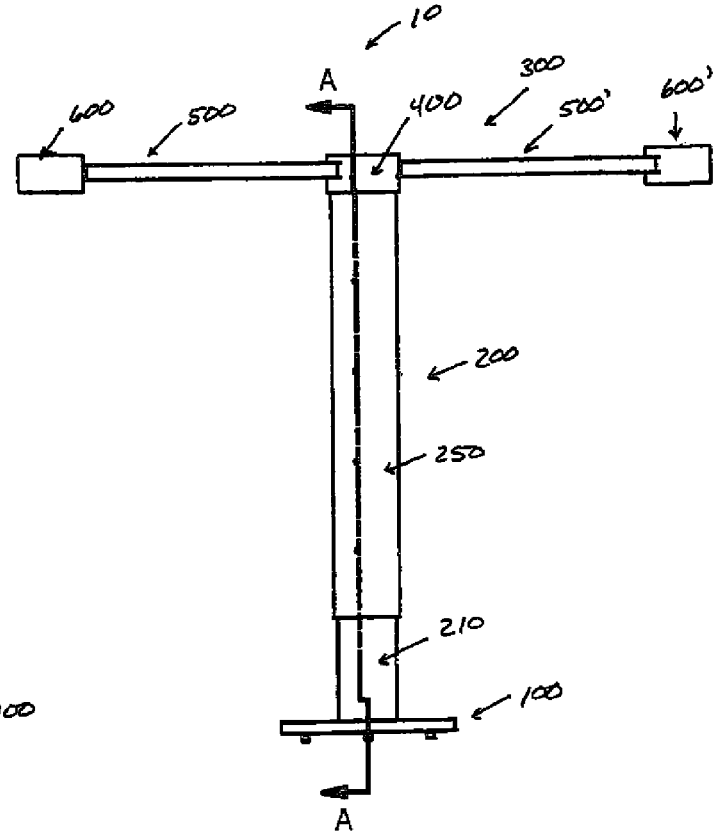
FIG. 2 is a schematic depicting a profile view of the training device depicted in FIG. 1.
Figure 5:
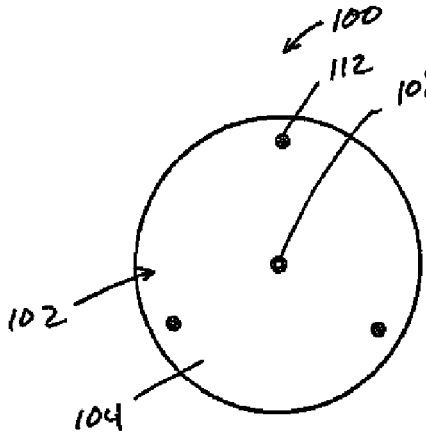
FIG. 5 is a schematic depicting a top side of the exemplary base depicted in FIG. 4.
Figure 4:
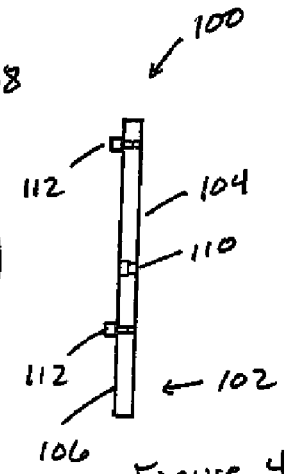
FIG. 4 is a schematic depicting a side sectional view of an exemplary base.
Figure 6:
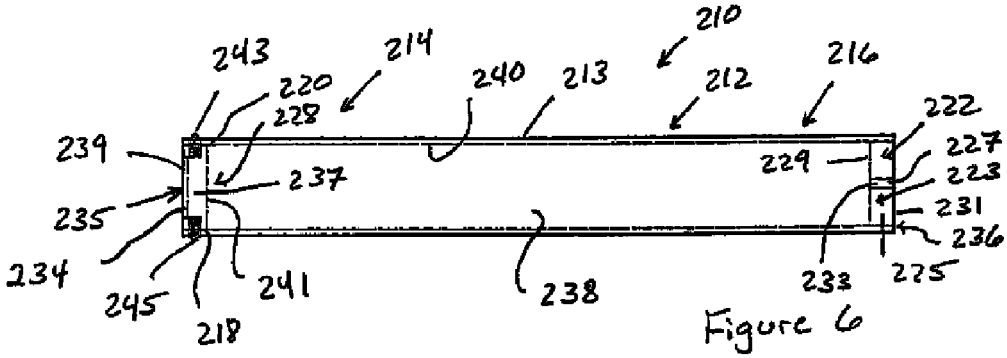
FIG. 6 is a schematic depicting an exemplary extension element of an exemplary telescopic member.

Referring to FIGS. 1-3, an exemplary training device 10 comprises a base 100, a telescopic member 200, and a ball securing member 300, wherein telescopic member 200 secures ball securing member 300 to base 100. Referring to FIGS. 4 and 5, base 100 comprises a body 102 having a top side 104 opposite to a bottom side 106. Centrally disposed through body 102 and extending from top side 104 to bottom side 106 is a hole 108. A lug 110 is inserted through hole 108 and protrudes from top side 104. Base 100 further comprises feet 112 radially disposed on bottom side 106 and extending therefrom, wherein feet 112 are positioned directly onto, for example, a basketball court, to secure base 100 to the court. To provide greater stability to training device 10, feet 112 extend from bottom side 106 to top side 104, and are flush with top side 104.

Referring to FIGS. 1-3, 6, and 7, telescopic member 200 comprises an extension member 210 and a sleeve 250. Extension member 210 receives sleeve 250 and secures sleeve 250 to base 100.

Extension member 210 comprises a body 212 having an essentially tubular configuration, wherein body 212 is defined at least in part by an anterior portion 214 at one end thereof, and by a posterior portion 216 at an opposite end thereof. Anterior portion 214 terminates at an anterior terminus 234 of body 212, and posterior portion 216 terminates at a posterior terminus 236 of body 212. Furthermore, anterior portion 214 of body 212 comprises a via 218 and a via 220 formed through body 212, wherein via 218 is formed opposite to and aligned with via 220.

Extension member 210 further comprises a cuff 222. Cuff 222 comprises a substantially tubular shaped body 223 defined by an exterior wall 225 surrounding a solid interior 227. Body 223 is capped at one end by an anterior wall 229 and at an opposite end by a posterior wall 231. Cuff 222 further comprises a channel 233 originating at posterior wall 231 and formed through at least a portion of interior 227.

Cuff 222 is disposed within a cavity 238 of body 212 such that exterior wall 225 of cuff 222 abuts an interior wall 240 of body 212. Posterior wall 231 of cuff 222 is flush with posterior terminus 236 of body 34.

Cuff 222 is joined and secured to base 100 by inserting lug 110 of base 100 into channel 233 of cuff 222. In an exemplary embodiment, lug 110 may comprise a threaded member, and channel 233 may be formed to include threads complementary to the threaded member such that lug 110 may be securely engaged within channel 233 via interaction of the respective threads.

Extension member 210 further comprises a cuff 228 disposed within cavity 238 of body 212. Cuff 228 comprises a body 235 defined at least in part by a substantially tubular exterior wall 237 capped at one end by an anterior side 239 and capped at an opposite end by a posterior side 241. Cuff 228 further comprises pins 243 and 245 which extend from exterior wall 237. Pin 243 is aligned with pin 245, and extends from a side of exterior wall 237 opposite to a side of exterior wall 237 from which pin 245 extends.

Exterior wall 237 of cuff 228 abuts interior wall 240 of body 212, and anterior side 239 is flush with anterior terminus 234 of body 212. Furthermore, a head of pin 243 extends through via 220 formed through body 235, and a head of pin 245 extends through via 218 formed through body 235 such that pins 243 and 245 protrude from an exterior wall 213 of body 212 of extension member 210. In an exemplary embodiment, each of pins 243 and 245 comprises a conventionally known spring mechanism whereby pins 243 and 245 can be compressed inwardly towards body 235 of cuff 222, and released to expand forward towards body 212 of extension member 210.

It is herein noted that in lieu of, or in addition to pins 243 and 245, sleeve 250 can be adjusted relative to extension member 210 and held thereto by, for example, a spring ball plunger as is known in the art.

Figure 7:
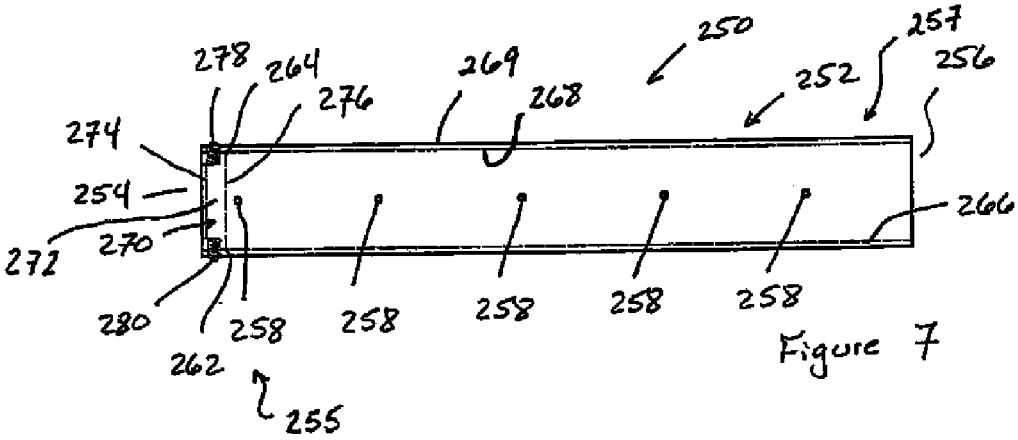
FIG. 7 is a schematic depicting an exemplary sleeve of an exemplary telescopic member.

As previously stated, telescopic member 200 further comprises a sleeve 250. Referring to FIG. 7, sleeve 250 comprises a substantially hollow tubular body 252. Body 252 is capped at one end by an anterior terminus 254 located at an anterior portion 255, and capped at an opposite end by a posterior terminus 256 located at a posterior portion 257, wherein a length of body 252 is defined by the distance between anterior terminus 254 and posterior terminus 256.

Body 252 of sleeve 250 comprises a series of holes 258 formed therethrough, wherein series 258 comprises holes sequentially spaced on and through body 252 to form a straight line of holes through and along a portion of the length of body 252. Body 252 further comprises a series of holes 260 formed therethrough, wherein series 260 comprises holes sequentially spaced on and through body 252 to form a straight line of holes through and along a portion of the length of body 252, wherein series 258 is aligned with and opposite to series 260.

Body 252 of sleeve 250 further comprises vias 262 and 264 formed through body 252. Via 262 is formed on an opposite side of body 252 as compared to via 264, and is aligned therewith. Furthermore, each of vias 262 and 264 is positioned towards anterior terminus 254 of sleeve 250 and do not overlap in space with the holes of series 258 and 260. Additionally, vias 262 and 264 are each positioned on a side of body 252 which is about 90 degrees from the side of body 252 upon which series of hole 258 and 260 are formed.

Sleeve 250 further comprises a cuff 270 disposed within a cavity 266 of body 252. Cuff 270 comprises a substantially tubular body 272 capped at one end by an anterior side 274 and capped at an opposite end by a posterior side 276. Cuff 270 further comprises pins 278 and 280 which extend from body 272. Pin 278 is aligned with pin 280, and extends from a side of body 272 opposite to the side of body 272 from which pin 280 extends.

Exterior wall 272 of cuff 270 abuts an interior wall 268 of body 252, which is opposite to an exterior wall 269 of body 252, and anterior side 274 is flush with anterior terminus 254 of body 252. Furthermore, a head of pin 278 extends through via 264, and a head of pin 280 extends through via 262. In an exemplary embodiment, each of pins 278 and 280 comprises a conventionally known spring mechanism whereby pins 278 and 280 can be compressed inwardly towards body 272 of cuff 270, and released to expand forward towards body 252 of sleeve 250. Alternatively, the pins may be replaced by a conventionally known spring ball plunger.

Sleeve 250 is attached to extension member 210 by positioning posterior terminus 256 over anterior portion 214 of extension member 210. While compressing pins 243 and 245, sleeve 250 may be slid over body 212. Sliding continues until a desired height of training device 10 is obtained, at which point pins 243 and 245 are released into the holes from series 258 and 260 with which pins 243 and 245 are aligned, thereby effecting the secure engagement and locking of pines 243 and 245 within the respective holes.

Referring to FIGS. 1-3, training device 10 further comprises a ball securing member 300. Ball securing member 300 comprises a collar 400, an arm 500, an arm 500', a receiving element 600, and a receiving element 600'.

Referring to FIGS. 1 and 8-12, collar 400 comprises a hollow tubular body 402 having an anterior terminus 404 opposite to a posterior terminus 406. Body 402 comprises a series of holes 408 formed therethrough, wherein the holes of series of holes 408 are positioned in a substantially linear fashion around body 402. Collar 400 further comprises a slot 410 and a slot 410' formed through an exterior side 403 of body 402, wherein slot 410 is positioned about 180 degrees from slot 410'.

Figure 9:
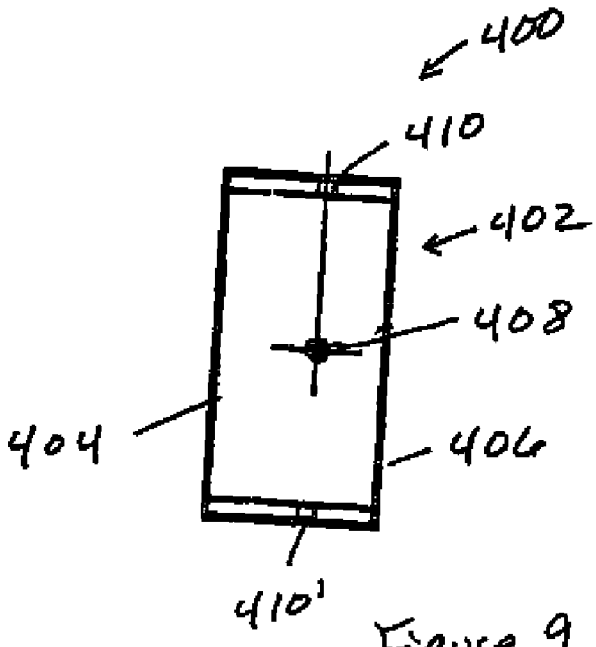
FIG. 9 is a schematic depicting a side view of the collar depicted in FIG. 8.
Figure 8:
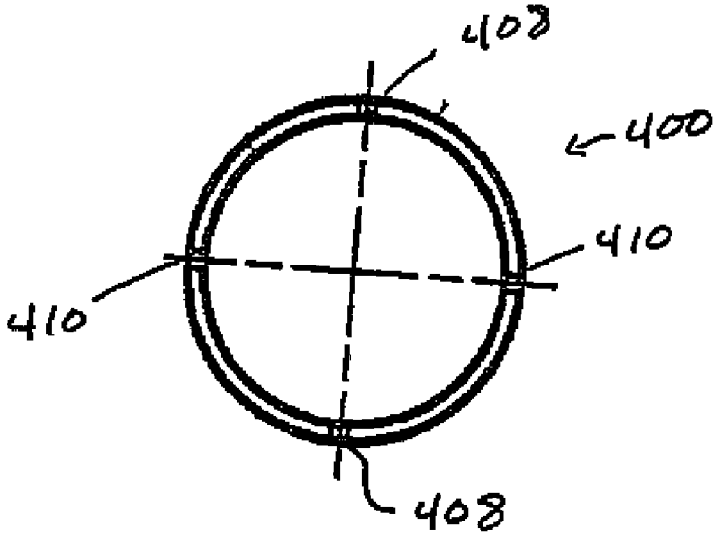
FIG. 8 is a schematic depicting a top view of an exemplary collar.

Referring to FIGS. 7-9, collar 400 is positioned onto telescopic member 200 by positioning posterior terminus 406 of collar 400 over anterior terminus 254 of sleeve 250 and by sliding collar 400 over body 252 until two holes from series of holes 408 are aligned with respective pins 278 and 280 of cuff 270. Pins 278 and 280 engage with the holes of collar 400 to securely hold collar 400 to telescopic member 200. Collar 400 can be removed from telescopic member 200 by disengaging pins 278 and 280 from the holes of series of holes 408, and by sliding collar 400 towards anterior terminus 254. Furthermore, the position of collar 400 can be changed in relation to telescopic member 200 by compressing pins 278 and 280 towards body 212 until pins 278 and 280 are disengaged from the holes of series of holes 408, and then rotating collar 400 until pins 278 and 280 are aligned with different holes of series of holes 408, and, thereby releasing pins 278 and 280 into the respective holes from series of holes 408 and locking collar 400 into position.

Figure 10:
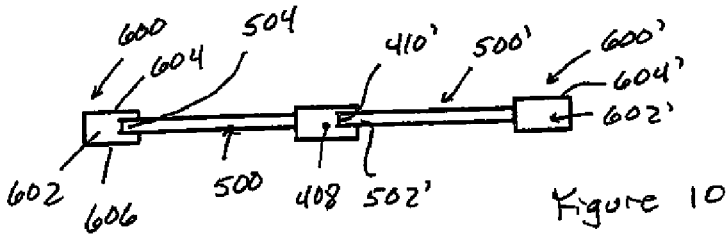
FIG. 10 is a schematic depicting a front side of an exemplary ball securing member.
Figure 12:
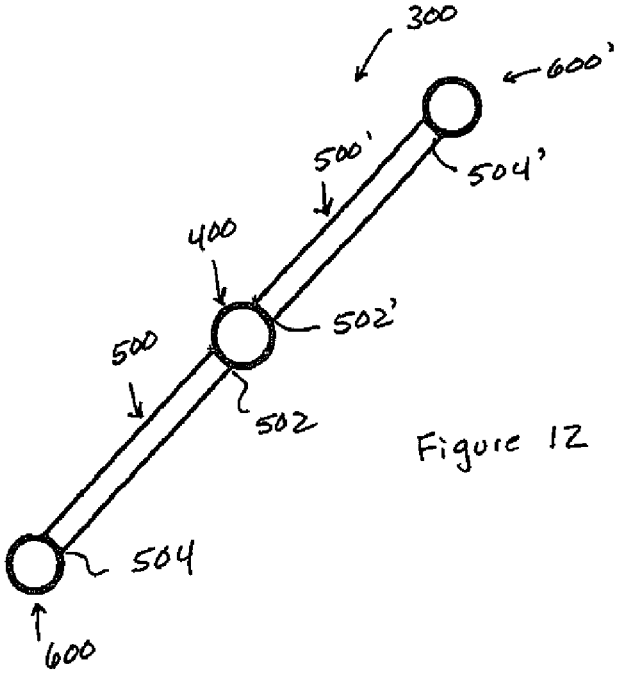
FIG. 12 is a schematic depicting a top of the ball securing member depicted in FIGS. 10 and 11.
Figure 11:
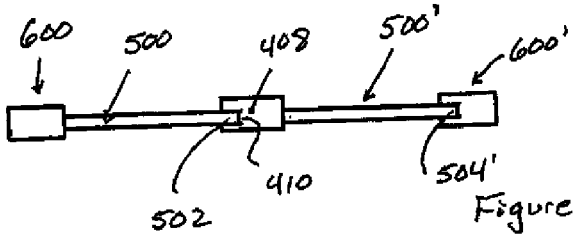
FIG. 11 is a schematic depicting a back side of the ball securing member depicted in FIG. 10.

Referring to FIGS. 10-12, arms 500 and 500' each respectively comprises a proximal terminus 502 and 502' opposite to a distal terminus 504 and 504'. Proximal termini 502 and 502' respectively interlock with slots 410 and 410' of collar 400.

Receiving elements 600 and 600' each respectively comprises a substantially tubular body 602 and 602' each respectively having a top side 604 and 604' opposite to a bottom side 606 and 606'. Body 602 and 602' is received and securely held by respective distal terminus 504 and 504' of arms 500 and 500' such that top sides 604 and 604' of receiving elements 600 and 600' are directed upwards away from the court. Top sides 604 and 604' are dimensioned such that a basketball may be placed atop top sides 604 and 604' and may be adequately held thereto until a player readily removes the basketball therefrom.

In the embodiment depicted in the figures, arms 500 and 500' are removable from collar 400, and receiving elements 600 and 600' are removable from respective arms 500 and 500'. However, it is also contemplated, that the arms and/or the receiving elements may be permanently attached to the respective holding elements.

Figure 13:
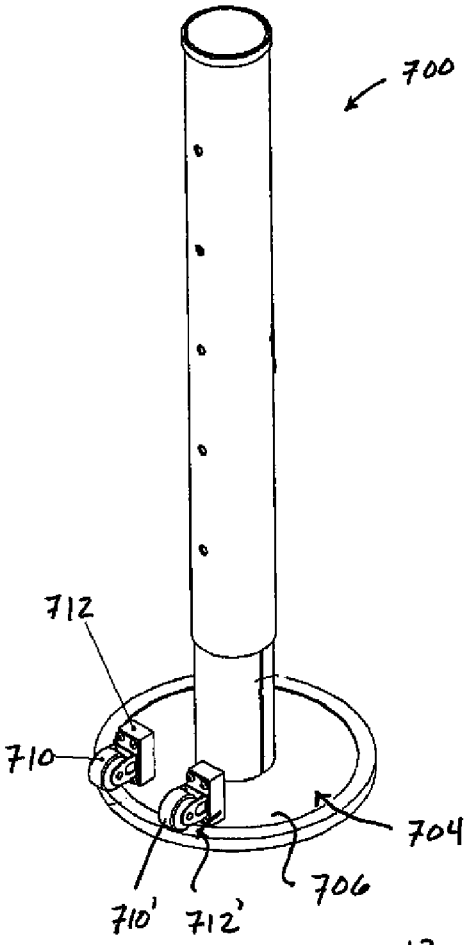
FIG. 13 is a schematic depicting another exemplary training device.
Figure 14:
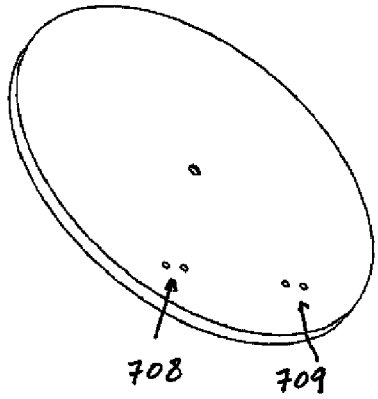
FIG. 14 is a schematic depicting an exemplary base of the training device depicted in FIG. 13.
Figure 15:
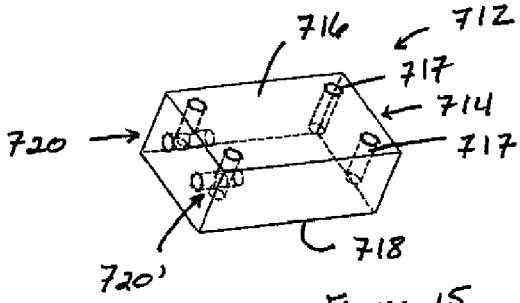
FIG. 15 is a schematic depicting an exemplary castor engaging member.

Another exemplary training device 700 is depicted in FIG. 13, wherein training device 700 is essentially identical in all respects to training device 10 except for the addition of castors 702, wherein castors 702 allow for the relatively easy transport of training device 700. Referring to FIGS. 13-15, training device 700 comprises a base 704 having a top side 706. Top side 706 has formed therein a set of holes 708 and a set of holes 710.

Training device 700 further comprises castors 710 and 710' respectively attached to a castor engaging member 712 and 712'. Referring to FIG. 115, each of castor engaging members 712 and 712' comprises a substantially block-like body 714. Body 714 comprises a set of holes 717 which extend from a bottom side 716 up towards a top side 718 of body 714. Set of holes 717 from one body 714 are aligned with set of holes 708 and secured thereto by screws (not shown) which are inserted through set of holes 717 and set of holes 708. Additionally, set of holes 717 from another body 714 are aligned with set of holes 709 and secured thereto by screws (not shown) which are inserted through set of holes 717 and set of holes 709. In this manner, then, castor engaging members 712 and 712' may be secured to base 704.

Again referring to FIG. 15, castor engaging members 712 and 712' each further comprises a set of castor receivers 720 and 720', which are conventionally known in the art, and which are designed to hold castors 710 and 710' thereto while allowing castors 710 and 710' to swivel.

As readily apparent to one of ordinary skill in the art, the arrangement of castors 710 and 710' on base 704, allows training device 700 to be slightly tipped and rolled, thereby effecting the ready transportability of training device 700.

There has thus been explained above, an exemplary training device that may effectively improve an athlete's ball shooting skills. Further modifications and alternative embodiments of various aspects of the invention may be apparent to those skilled in the art in view of the description. Accordingly, the description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently or multiplied, all as would be apparent to one skilled in the art after having the benefit of this description of the invention.

Based on the above-provided description, the various uses of the training device in the training of basketball shooting may be readily appreciated by one of ordinary skill in the art. That is, the telescopic mechanism allows the height of the training device to be adjusted, thereby accommodating the various sizes of the individual athletes, and also allowing an individual athlete to practice shooting the basketball wherein the basketball is received at approximately the same location on the court, but from a number of different heights. Furthermore, the ability to adjust the collar of the ball securing member such that the receiving element can essentially be swung or rotated about the telescopic member, allows an athlete to practice shooting the ball from various locations on the court. Accordingly, by varying both the position of the collar and the height of the telescopic mechanism, the athlete can practice shooting the ball from various positions and heights on the court, wherein such an ability has obvious advantages in the overall development of the athlete's ball shooting skills.

What is claimed is:

1. A sports training device for use in training an athlete to shoot a ball from a variety of heights and from a variety of locations on a court, comprising:

a first ball;

a telescopic member comprising a sleeve and an extension member, wherein the sleeve is slidably engaged with the extension member to thereby adjust a height of the telescopic member such that the athlete may practice shooting the first ball from a variety of heights;

a base which receives and holds the extension member thereto; and a ball securing member comprising:

a collar which is secured to the sleeve of the telescopic member so that the collar is rotatable around a rotational axis of the sleeve of the telescopic member to thereby adjust the first ball's location;

a first arm which extends outwardly from an exterior side of the collar; and a first receiving element attached to the first arm, wherein the first receiving element comprises a body having a top side opposite to a bottom side, wherein the first ball is positioned on and held by the top side.

2. The sports training device of claim 1, wherein:

the extension member comprises:

a substantially tubular shaped body having a cavity formed in an anterior portion of the body;

a first cuff disposed within the cavity in the anterior portion of the body, wherein the first cuff comprises a sleeve engaging member which holds the sleeve to the extension member in an adjustable manner;

the sleeve comprises:

a substantially tubular shaped body, wherein a first plurality of holes is formed through and extends longitudinally along the body of the sleeve, and further wherein the sleeve engaging member of the first cuff of the extension member is engaged with a hole of the first plurality of holes to secure the sleeve to the extension member;

a cavity formed in an anterior portion of the substantially tubular shaped body of the sleeve, wherein the cavity of the sleeve receives a second cuff, wherein the second cuff comprises a collar receiving member which extends through an exterior wall of the substantially tubular shaped body of the sleeve; and the collar comprises:

a substantially tubular shaped body having a plurality of holes formed around a circumference of the substantially tubular shaped body of the collar, wherein the plurality of holes of the collar engage with the collar receiving member of the second cuff such that the radial position of the collar relative to the sleeve may be adjusted;

wherein the sports training device further comprises:

a second ball;

a second arm which extends outwardly from the exterior side of the collar; and a second receiving element attached to the second arm, wherein the second receiving element comprises a body having a top side opposite to a bottom side, wherein the second ball is positioned on and held by the top side of the second receiving element such that the athlete may alternate the shooting of the first ball and the second ball.

3. The sports training device of claim 2, wherein the first ball and the second ball each comprises a basketball.

* * * * *